US005411206A

United States Patent [19]

Latham et al.

[11] Patent Number: 5,411,206

[45] Date of Patent: May 2, 1995

[54] SELF-RIGHTING PROTECTIVE STRUCTURAL DEVICE FOR A RURAL MAILBOX

[76] Inventors: Thmas C. Latham, 2916 Broadway, Toledo, Ohio 43614; Ronald J. Majerowski, 12 N. Lathrop Rd., Swanton, Ohio 43558

[21] Appl. No.: 246,846

[22] Filed: May 20, 1994

[51] Int. Cl.[6] ..... B65D 91/00

[52] U.S. Cl. ..... 232/39; 248/417

[58] Field of Search ..... 232/39, 17, 38; 248/146, 417

[56] References Cited

U.S. PATENT DOCUMENTS

| | | | |
|---|---|---|---|
| 759,437 | 5/1904 | Harward | 232/39 |
| 808,872 | 1/1906 | Raymond | 232/39 |
| 820,841 | 5/1906 | Aarseth | 232/39 |
| 2,477,276 | 7/1949 | Walton | 232/39 |
| 2,656,138 | 10/1953 | Kaschak | 232/39 |
| 3,367,613 | 2/1968 | Christensen | 248/417 |
| 4,286,747 | 9/1981 | Deike | 232/39 |

*Primary Examiner*—Michael J. Milano
*Attorney, Agent, or Firm*—Robert E. Witt

[57] ABSTRACT

There is disclosed a rotatable post-arm assembly in combination with a rotatable protective cladding-rural mailbox assembly, wherein the post-arm assembly is movable axially and the arm serves as a mounting device and axle for the protective cladding-rural mailbox assembly, the latter of which is movable radially, upon the application of an outside force, and the combination is self-righting to its original position upon the removal of such outside force, whereby the combination protects the mailbox from damage by vandals, weather, snowplows, errant drivers and the like, and provides a measure of safety for the user upon retrieval of mail therefrom.

8 Claims, 2 Drawing Sheets

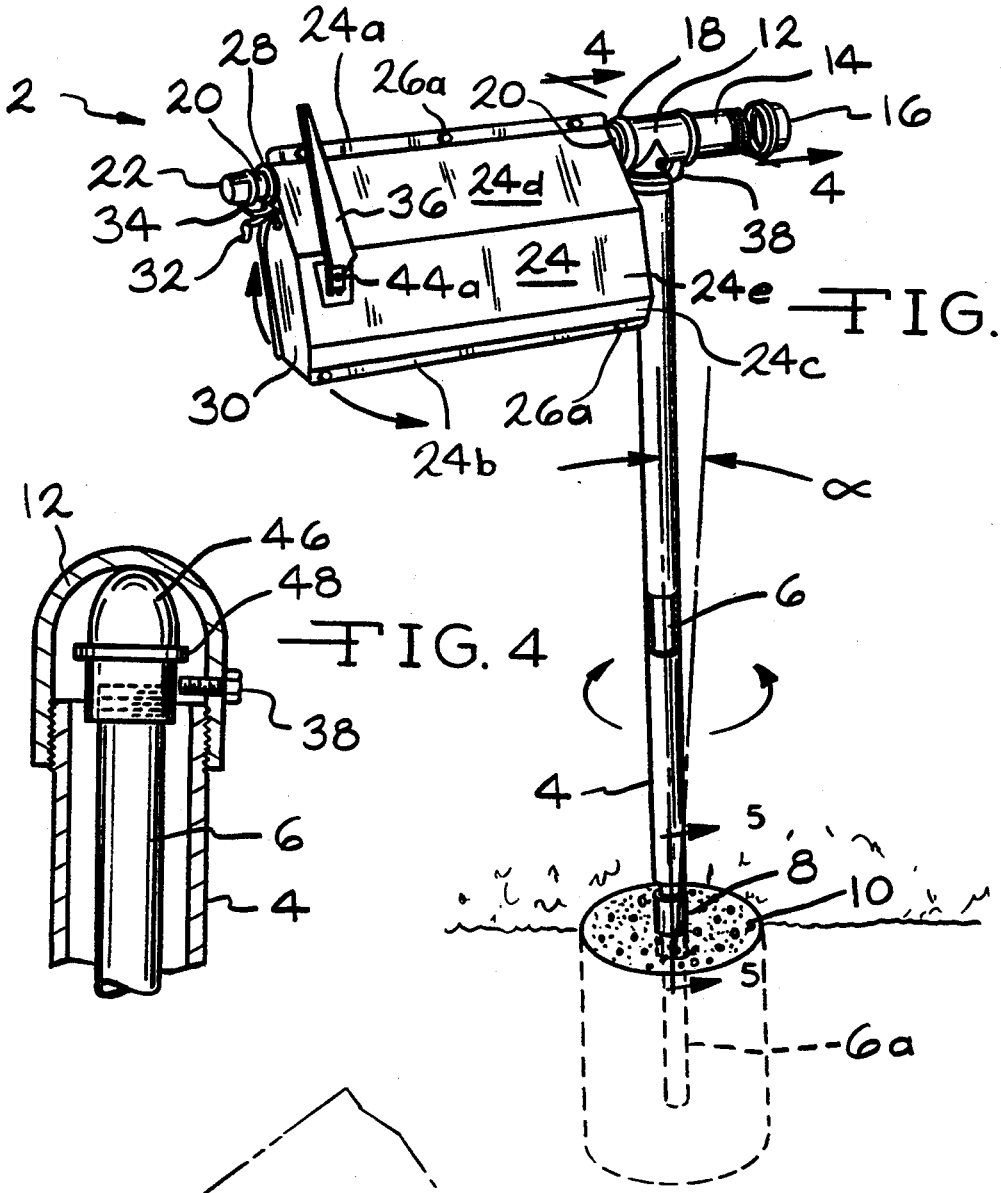
FIG. 1
FIG. 4
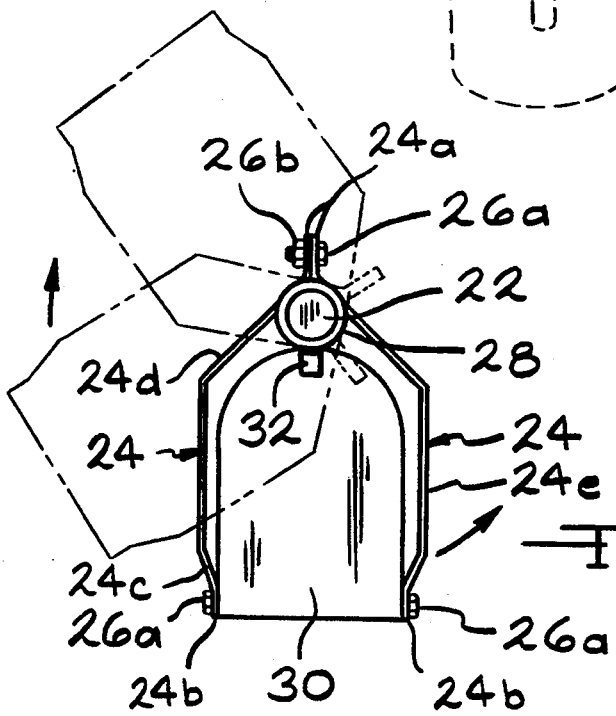
FIG. 2

SELF-RIGHTING PROTECTIVE STRUCTURAL DEVICE FOR A RURAL MAILBOX

BACKGROUND OF THE INVENTION

This invention relates to a combination of structural elements which enables users of standard rural mailboxes to protect such mailboxes from damage and/or destruction from outside forces, including vandalism, weather, snow plows and errant drivers, and further provides users with a margin of safety upon retrieval of mail therefrom.

More specifically, this invention relates to a rotatable, self-righting protective structural device for a rural mailbox, comprising a post-arm assembly and a protective cladding-mailbox assembly each assembly of which is rotatable upon the application of an outside force, to reduce the effect of such force and thereby protect the integrity of the mailbox. Thereby, upon installation of the device directly into the ground or set within a cement casing in the ground, axial rotation of the post-arm assembly and radial rotation of the protective cladding-mailbox assembly allows the device to "cushion" the blow of such outside force.

Heretofore, it has been common practice to permanently and rigidly attach mailboxes to posts and to replace damaged or destroyed rural mailboxes and posts, at considerable inconvenience and/or expense, requiring a new post and a new mailbox and time to assemble and reset the same in the ground.

There are other problems with the use of permanently and rigidly attached mailboxes to posts, most notable being that there is no "give" therewith, upon the application of an outside force, i.e. when the post breaks, e.g. by an errant vehicle, many times it acts as a missal, crashing through windshields and/or striking persons or property in close proximity thereto. And, there are additional problems with the use of permanently and rigidly attached units, most notably being interruption of mail service, upon breakage of the post or mailbox, until repairs and/or replacement are made.

Rotatable posts and/or self-righting features for mailbox assemblies have been available for sometime, but protective cladding attached to the mailbox and means to allow for radial rotation of such cladding-mailbox assembly about an arm extending from the post, have not been available. And, some attempts to combine axial rotation and self-righting features to a mailbox assembly, appear to be cumbersome and difficult to retrieve mail therefrom.

Many times, use of a rigid post, permanently and rigidly attached to a mailbox, is sufficient for rural use, but upon being damaged, from whatever source, interruption of mail service and inconvenience and cost of replacement were a way of life.

Up to the present time, the usual means for preventing interruption of mail services was to temporarily prop up the unit until a replacement unit could be purchased and reset.

SUMMARY OF THE INVENTION

The present invention however, provides axial rotation of the post-arm assembly and radial rotation of the cladding-mailbox assembly, to substantially protect the structural device, in combination, and to provide ease of retrieval of mail with safety by not having to carefully approach the street and look for passing vehicles, prior to checking the mailbox for mail. Even when the structural device of the present invention is knocked down, as for example, by a snow plow or other vehicle, interruption of mail service is generally averted or kept to a minimum, by merely resetting the post of the post-arm assembly into the ground. The protective cladding protects the mailbox and the rotational features of the structural device, axially and radially, prevents major damage, scratches and scrapes notwithstanding.

The post-arm assembly is preferably fabricated from steel pipe, standard black maleable iron, and from associated fittings and accessories. The post comprises concentrically mounted tubing or pipes, preferably a 2" pipe for the exterior tubing and 1¼" pipe for the interior tubing. The interior tubing is preferably about 7 feet long, with about 3 feet thereof being set into the ground, directly or in a cement casing. The exterior tubing is mounted over the interior tubing and is fitted with a 2" pipe tee at its top end. A horizontal arm is attached to one opening of the tee and preferably an extension is attached to the other end of the tee to function as a handle for the user to swing the device to a desired position for easy, safe retrieval of mail. The horizontal arm is of a length somewhat larger than the length of a rural mailbox, and preferably is a 1" pipe, thereby requiring a 2:1 reducer at that end of the tee. The handle is preferably a 2" pipe.

Some preference may be given to a single 7 foot long pipe, but two sections, one 4 feet the other 3 feet, joined by a break-away coupling is preferred by others, due to ease of handling.

The protective cladding for the cladding-mailbox assembly is fabricated from preferably 14 gage steel, attached to the mailbox, and is shaped to size to cover the sidewalls and top of the mailbox, with sufficient room to allow for a cavity the length of the cladding-mailbox assembly to accommodate the horizontal arm of the post-arm assembly. At the same time, aesthetic features are preferably given to the cladding material, so that the user can be proud of its appearance and pleased with its function.

Retaining means on the end of the horizontal arm, such as a mechanical bushing and/or an end cap is sufficient to hold the cladding-mailbox assembly thereon, without interfering with the rotational movement of the cladding-mailbox assembly.

By design, the top of the internal tubing of the post-arm assembly is fitted with a pivot means, such as an acorn cap, preferably aluminum, which is press-threaded onto the internal tubing, for rotational engagement with the interior surface of the tee.

Also, by design, the cladding is shaped to accommodate the opening and the closing of the door of the mailbox, thereby requiring an off-set area as shown and later described.

Additionally, to prevent unwanted disassembly of the post-arm assembly, it is preferred to employ an anti-theft bolt, which by design passes through a threaded opening of an annular surface of the tee, for a distance approximately even with the sidewall of the acorn cap, but which bolt is prevented from clearing a radially extending lip on the acorn cap.

One advantage of the present invention is that the self-righting protective structural device "gives" with the force of a blow or a hit, and swings and returns to its original position.

Another advantage of the present invention is that rotation about the horizontal and vertical axes of the device, in conjunction with the protective cladding, protects the rural mailbox from damage.

Still another advantage of the present invention is that safety to the user of the device is inherent with the retrieval of mail, by the user merely rotating the device to his/her position, away from the road surface, retrieving mail, and releasing the device, for its return to its original position.

The present invention has proven to be well suited to longevity of operation, as the component parts of the device are durable and strong, and can withstand crushing blows of snowplows, errant drivers, vandal's acts of force, and weather.

It is therefore an object of the present invention to provide a simple, protective, rotatable structural device for a rural mailbox.

It is another object of the present invention to provide a self-righting structural device which facilitates safe use, especially upon retrieval of mail from the mailbox.

One essential feature of the present invention is the alignment of the internal tubing or pipe of the post-arm assembly at a small angle with ground level, relative to the road or street. The angle is generally set at from 2° to 7°, but preferably is set at from 3° to 5°.

BRIEF DESCRIPTION OF THE DRAWINGS

FIG. 1 is a perspective view of a self-righting structural device for a rural mailbox assembled and installed;

FIG. 2 is a partial front view of a rotatable protective cladding mailbox assembly showing various levels of rotation;

FIG. 4 is a partial cross-sectional view taken along line 4—4 of FIG. 1;

DETAILED DESCRIPTION OF THE PREFERRED EMBODIMENT

Figure 5:
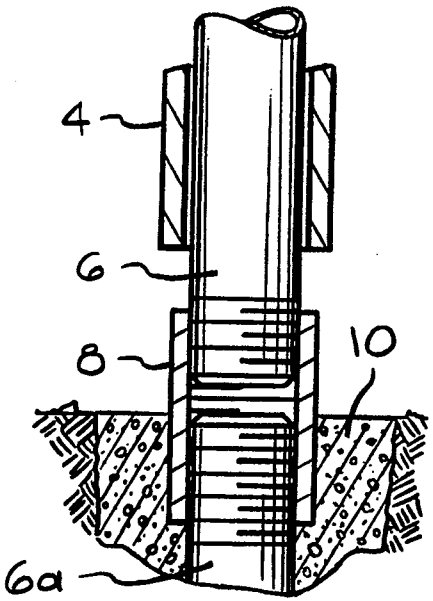
FIG. 5 is a partial cross sectional view taken along line 5—5 of FIG. 1.

The self-fighting protective structural device for a rural mailbox finds particular utility in rural, country environments, where the mailboxes are generally set close to roadways to facilitate delivery of mail via some form of vehicle and where snowplows and/or the snow pushed therefrom strikes many such rural mailboxes.

Specifically, the self-righting protective structural device of this invention finds utility to all users of the standard rural mailbox, by providing protection against destruction and by providing rotation of the post-arm assembly and rotation of the cladding-mailbox assembly in response to any outside force, to thereby cushion the blow and lessen the potential for damage. Likewise, utility of the present invention is found in the safety feature available to users, which enables them to rotate the device so they can retrieve mail easily, without having to get on the road surface and be fearful of being struck by a vehicle.

In the construction of the structural device, it is important to use durable, strong component materials capable of supporting a rural mailbox and capable of longevity, to withstand substantial abuse by weather, vehicles, vandals and snow from snowplows.

At the same time, it is important that the portion of the post which is set in the ground be aligned with the ground at a small angle, and be maintained, at the recommended angle of from 2–7 degrees to benefit from the self-righting features of the device.

These requirements indicate the necessity for providing strong structural components of measured dimensions to realize cooperating engagement of said components, especially the rotational features of the device.

Referring to FIG. 1, a self-righting protective structural device for a rural mailbox 2 as shown comprising an exterior tubing 4, preferably a 2" steel pipe serving as one portion of the post, surrounding an interior tubing 6, preferably a 1¼" steel pipe, serving as the other portion of the post. A break-away coupling 8, generally located at ground level, as shown, connects interior tubing 6 to interior tubing 6*a*, the latter of which is embedded in cement casing 10. The overall length of the interior tubings 6, 6*a* is about 7 feet, and the individual length of each is about 4 feet and 3 feet respectively.

A 2" steel pipe tee 12, having annular side-walls through which a security bolt 38 passes therethrough to prevent theft of the device, is fluid to the top of exterior tubing 4 and a 2" steel pipe nipple 14 is fitted to one end of the pipe tee 12, and a 2" steel pipe cap 16 is fitted on the end of the pipe nipple 14. At the other end of the pipe tee 12, a 2" - 1" steel pipe reducer 18 is fitted thereon to receive a substantially horizontal 1" steel pipe 20, serving as an arm, fitted with a 1" steel pipe cap 22.

Protective cladding 24, shows top ridge 24*a*, bottom ridge 24*b*, off-set 24*c*, slanted side wall 24*d* and vertical side wall 24*e* mounted to a rural mailbox, the door 30 of which is visible. Nuts 26*a* are used to fasten the cladding 24 to the mailbox along bottom ridge 24*b* and to fasten the top ridge 24*a*.

The cladding-mailbox assembly thus formed comprises a cavity at its upper portion to receive the 1" steel pipe 20 and is prevented from slipping off the pipe 20 by a machined bushing 28.

The door latch 32 engages the latch receiver 34 to ensure a secure closure of door 30 of the mailbox, and the flag assembly 36 is held in position by screw 44*a*.

As shown in FIG. 1, the post-arm assembly is set at a small angle to the ground, and is rotatable axially, wherein such angle provides self-righting capability to the device, and the cladding-mailbox assembly is rotatably radially about pipe 20, upon the application of an outside force to the device.

Referring to FIG. 2, protective cladding members 24 are shown to be joined at top ridges 24*a*, via bolt 26*a* and nut 26*b*, to form a housing about the profile of door 30 of the mailbox, whereby the cladding members 24 further comprise an off-set area 24*c* to allow door 30 to open and close without binding or scraping the cladding members 24. Slanted side walls 24*d* and vertical side walls 24*e* and bottom ridges 24*b* complete the profile of the housing, where bolts 26*a* secure the cladding members 24 to the bottom of the side walls of the mailbox, as better depicted in FIG. 3.

The housing formed by joining cladding members 24 and by securing the same to the mailbox, defines the cladding-mailbox assembly, which shows space or a cavity at its upper area, sufficient to receive the horizontal arm (not shown) from the post-arm assembly. However, end cap 22 and mechanical bushing 28 are shown to maintain the cladding-mailbox assembly on the horizontal ann. Door latch 32 is shown at the top of door 30 to maintain closure of door 30. The radial rotation of the cladding members is shown in phantom indicate the degree of rotation possible upon application of an outside force of the device.

The movement, via rotation, axially and radially of the device of this invention, in combination with the protective cladding guarding the mailbox, provides the basis for protection of the mailbox.

Figure 3:
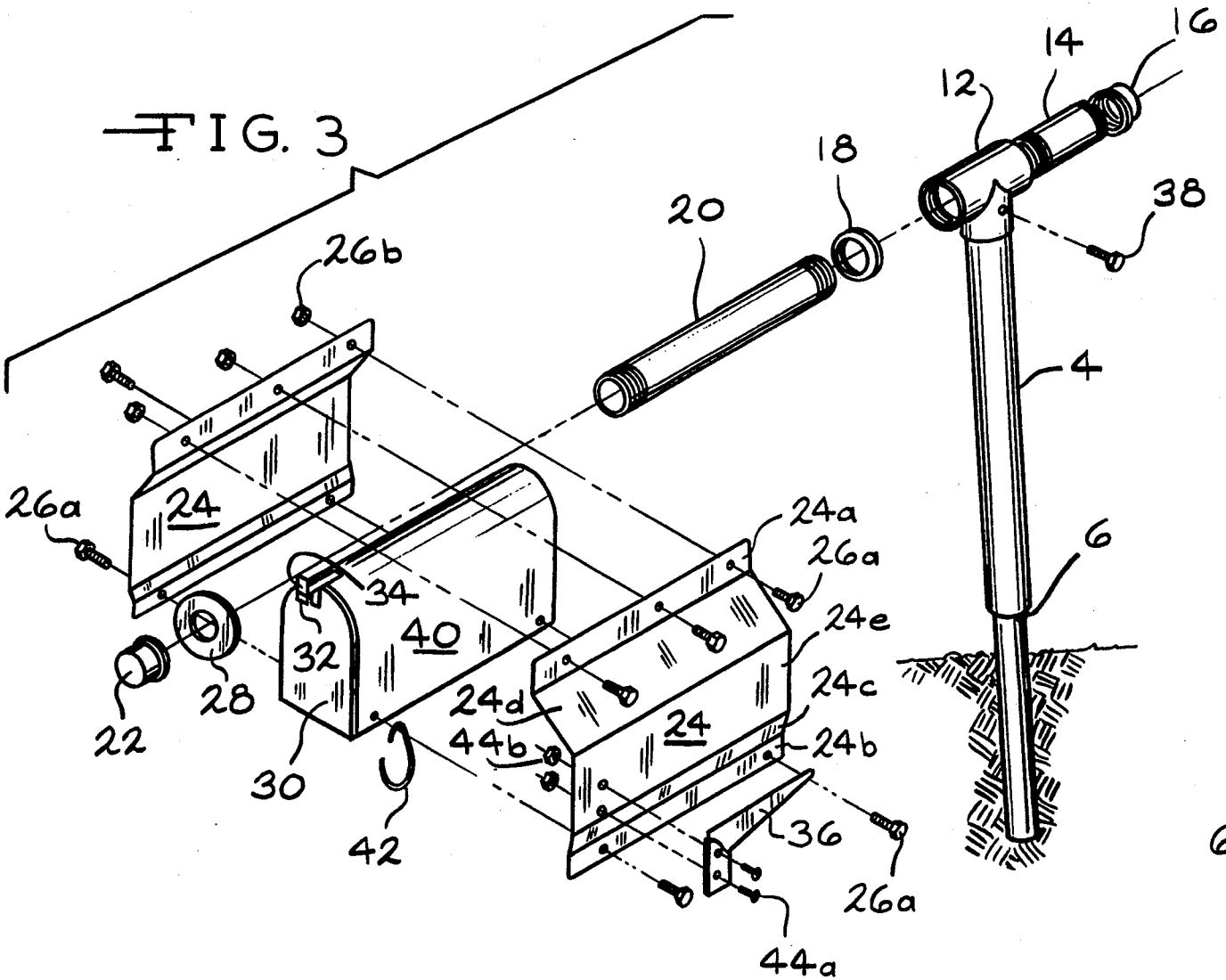
FIG. 3 is a partial exploded perspective view of a self-righting structural device for a rural mailbox.

Referring to FIG. 3, a partially exploded perspective view of the device is shown, whereby internal tubing 6 is set directly into the ground, preferably to a depth of 3 feet to leave a balance of 4 feet above ground. Exterior tubing 4 is concentrically mounted over interior tubing 6 and pipe tee 12 is attached to the top end of exterior tubing 4, whereby on once end of the tee 12, a pipe nipple 14 and pipe cap 16 are attached to provide a handle for the user to help rotate the device upon retrieving mail from the mailbox without having to enter the road surface.

Pipe reducer 18 is shown to be necessary to obtain a threaded fit to a smaller diameter horizontal pipe 20, which serves as an arm to receive the cladding 24,24 - mailbox 40 assembly, shown in the exploded perspective view. Mailbox 40, comprising door 30, latch 32 and latch receiver 34, and further comprising a flyer hook 42, and flag assembly 36 secured thereto by screws **44*a* and nuts 44*b*, is ready for the construction of the cladding-mailbox assembly, whereby cladding members 24,24 each comprising top ridge 24*a* would be joined via bolts 26*a* and nuts 26*b* to provide a housing, and bolts 26*a* secure said housing to the mailbox 40 along the bottom ridge 24*b* of the cladding 24, 24. Offset 24*c* adjacent bottom ridge 24*b*, and slanting side wall 24*d* and vertical side wall 24*e* comprise the preferred structure of each cladding 24 used in combination with the other elements of the structural device. Machined bushing 28 fits over pipe 20 and pipe cap 22 is threaded onto pipe 20 to secure the cladding-mailbox assembly on pipe 20. A security bolt 38 is shown for engagement with the pipe tee 12**.

Referring to FIG. 4, a partial cross-sectional view taken along line 4—4 of FIG. 1, interior tubing 6 is shown with an acorn cap 46, preferably of aluminum, threaded thereon, to serve as a pivot means, for rotational engagement with the interior surface of the pipe tee 12. Exterior tubing 4 is shown in concentric engagement with interior tubing 6, and security bolt 38 is shown passing through the pipe tee 12 and is of such length that it cannot be raised beyond radial lip 48 integral with the acorn cap 46, thereby serving as an anti-theft means of the structural device of the invention.

Referring to FIG. 5, a partial cross-sectional view taken along line 5—5 of FIG. 1, internal tubing **6, 6*a* is shown joined by break-away coupling 8 via threaded engagement, wherein the internal tubing 6*a* and a portion of break-away coupling is shown imbedded in a concrete casing 10 approximately half its length to help maintain a 4 foot length of interior tubing 6 above ground. Additionally, external tubing 4 is shown in concentric engagement with internal tubing 6, with sufficient room to clear the breakaway coupling 8 so as not to impede the rotational capabilities of the external tubing 4 about the internal tubing 6**.

The structural elements of this invention are not limited to steel. Synthetic materials, such as high impact resistant PVC can be used in place thereof.

Modification of the disclosed combination may be resorted to without departing from the spirit and scope of the appended claims.

What is claimed is:

1. A self-righting protective structural device for a rural mailbox, comprising a rotatable post-arm assembly and a rotatable protective cladding-mailbox assembly, further comprising in combination:

(a) Concentrically mounted substantially vertical tubings aligned at a small angle with ground level, comprising an interior tubing and an exterior tubing, said interior tubing and said exterior tubing further comprising a bottom end and a top end, wherein said bottom end of said interior tubing is set below said ground level;

(b) A tee mounted upon said top end of said exterior tubing, said tee comprising an interior surface and an annular sidewall;

(c) A substantially horizontal tubing comprising a near end and a far end, wherein said near end of said tubing is fitted to said tee at one end of said tee at said top end of said exterior tubing to form said post-arm assembly;

(d) Pivot means mounted upon said top end of said internal tubing, said pivot means comprising an annular sidewall and a radially extending lip and a top-bearing surface for rotational engagement with said interior surface of said tee;

(e) Protective cladding sufficient in size to cover a standard rural mailbox, said protective cladding being secured to said mailbox to form said cladding-mailbox assembly, said assembly further comprising a cavity for reception and rotational engagement of said assembly about said substantially horizontal tubing; and (f) Retainer means located on said far end of said substantially horizontal tubing to retain said cladding-mailbox assembly on said substantially horizontal tubing without interfering with said rotational engagement of said assembly about said substantially horizontal tubing;

whereby said post-arm assembly is rotatable axially about said interior tubing and said cladding-mailbox assembly is rotatable radially about said substantially horizontal tubing upon application of an outside force, and said post-arm assembly and said cladding-mailbox assembly are self-rightable upon removal of said outside force, to provide protection to said mailbox and to provide safe retrieval of mail from said mailbox.

2. A structural device as claimed in claim 1, wherein said angle is from 2–7 degrees.

3. A structural device as claimed in claim 1, wherein said angle is from 3–5 degrees.

4. A structural device as claimed in claim 1, wherein said interior tubing comprises at least two lengths joined by a break-away coupling, said coupling generally being located at ground level.

5. A structural device as claimed in claim 1, wherein said protective cladding comprises a pair of identically shaped members, each comprising a top ridge, a bottom ridge and an off-set area adjacent said bottom ridge, said members being aligned to form a housing to cover said mailbox which further comprises a door, said members being joined along said top ridge and said members being attached to said mailbox along said bottom ridge, whereby said off-set facilitates opening and closing of said door.

6. A structural device as claimed in claim 1, wherein said tee is fitted with a short tubing at its other end to provide a handle on said post-arm assembly to facilitate rotation during retrieval of mail from said mailbox.

7. A structural device as claimed in claim 1, wherein said annular sidewall of said tee comprises a threaded opening for a retainer bolt passing through said sidewall a distance whereby said bolt cannot clear said radially extending lip of said pivot means to serve as an anti-theft mechanism.

8. A structural device as claimed in claim 1, wherein said tee is fitted with a reducer at said one end to accommodate said substantially horizontal tubing of smaller diameter than said external tubing attached to said tee, whereby said cavity comprises a minimum space to accommodate aesthetics of said device at no sacrifice to function.

* * * * *